United States Patent [19]

Stumpf

[11] Patent Number: 4,578,834

[45] Date of Patent: Apr. 1, 1986

[54] INNERSPRING CONSTRUCTION

[75] Inventor: Walter Stumpf, Dunwoody, Ga.

[73] Assignee: Simmons U.S.A. Corporation, Atlanta, Ga.

[21] Appl. No.: 586,867

[22] Filed: Mar. 9, 1984

[51] Int. Cl.[4] ..... A47C 27/04

[52] U.S. Cl. ..... 5/477; 5/475; 156/70; 156/291

[58] Field of Search ..... 5/477, 475, 448, 481; 156/70

[56] References Cited

U.S. PATENT DOCUMENTS

| | | | |
|---|---|---|---|
| 698,529 | 4/1902 | Marshall | 5/477 |
| 2,296,807 | 9/1942 | Cavaler | 5/477 |
| 2,320,153 | 5/1943 | Moske . | |
| 2,862,214 | 12/1958 | Thompson et al. . | |
| 3,230,558 | 1/1966 | Duncan | 5/477 |
| 4,045,833 | 9/1977 | Mesek et al. | 5/484 |
| 4,234,984 | 4/1980 | Stumpf | 5/477 |
| 4,403,356 | 9/1983 | Urai | 5/481 |

FOREIGN PATENT DOCUMENTS

| | | | |
|---|---|---|---|
| 2757975 | 6/1979 | Fed. Rep. of Germany | 5/481 |

*Primary Examiner*—Alexander Grosz

*Attorney, Agent, or Firm*—A. Thomas Kammer

[57] ABSTRACT

An innerspring construction including adhered strings of pocketed coil springs is provided together with a method of manufacture. Each string is defined by a series of coil springs connected and encased by a fabric cover. The strings are connected to each other by an adhesive applied between the lines of tangency of adjacent coil springs. A method is provided for assembling such a construction. A hot melt adhesive applicator traverses a string of pocketed coil springs depositing a precise amount of adhesive on each coil jacket. A second string is positioned on the first and pressure applied thereto. The applicator then traverses the second string in the same manner as the first. For purposes of efficiency, it may traverse the second string in the opposite direction from which it originally moved with respect to the first. The sequence is repeated until an innerspring construction of desired size is created.

16 Claims, 7 Drawing Figures

FIG.4
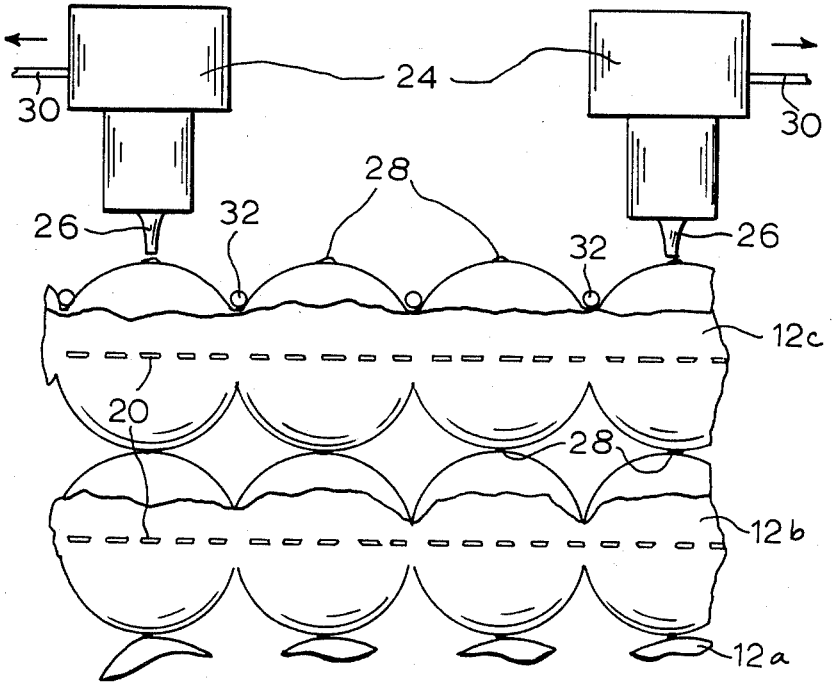
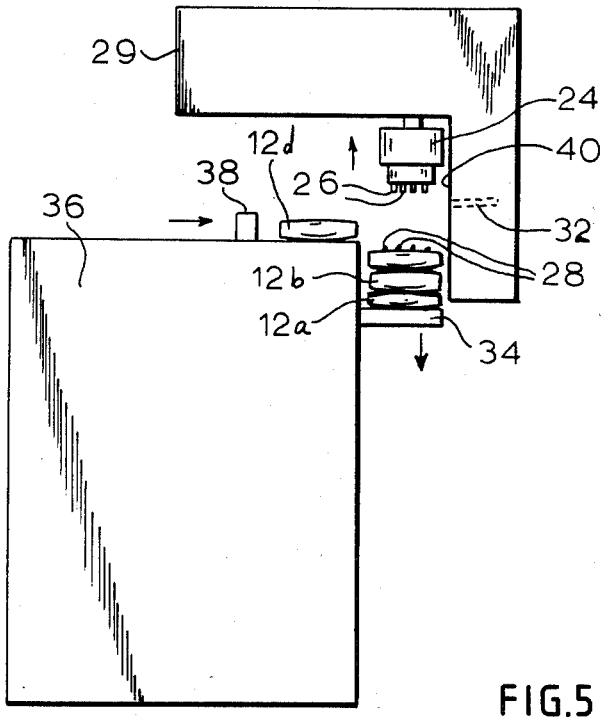
FIG.5

INNERSPRING CONSTRUCTION

BACKGROUND OF THE INVENTION

1. Field of the Invention.

The field of the invention relates to an innerspring construction including strings of pocketed coil springs interconnected by a hot melt adhesive or the like along the tangential lines of intersection of the adjacent strings. A method for manufacturing such a construction is also provided.

2. Brief Description of the Prior Art.

Innerspring constructions including pocketed coil springs have been manufactured for many years and offer certain advantages over competitive assemblies. Various means have been used to connect adjacent rows or strings of pocketed springs.

U.S. Pat. No. 698,529 to Marshall discloses strings of coils connected by links to form a square arrangement. A different arrangement including hog rings is provided in U.S. Pat. No. 2,320,153. Utilization of such rings is slow and expensive as the operator not only has to position the coils, but has to apply a hog ring by piercing the pocket wrap material and catching the wire defining the top convolution of the coil.

U.S. Pat. No. 2,862,214 concerns a cushion including a string of pocketed coils which is folded back and forth within a cavity formed by side wall pads. The springs are held in position by mutual engagement as well as by the surrounding side wall pads. The interior surfaces of the cover and bottom pads are coated with an adhesive. The fabric strip which defines the spring compartments may be coated with an adhesive either in its entirety or at the ends of the compartments. Such procedures yieldably maintain the springs in their individual positions.

U.S. Pat. No. 4,393,792 discloses an apparatus for assembling innerspring constructions by pulling lengths of twine therethrough with needles. This produces a nested array of pocketed coil springs. The assembly process is labor and material intensive. The operator positions coils on the rack and forces them to a nesting pattern. Needles are actuated which pierce the racked construction. Assembly strings are applied and tied off with the tightness of the assembly being dependent on operator skill.

A square array of pocketed springs is disclosed in U.S. Pat. No. 4,234,984. Adjacent strings of coils are secured to each other along the fabric connecting alternating coil springs. A structure having a clover leaf pattern is accordingly obtained.

SUMMARY OF THE INVENTION

It is an object of the invention to provide an innerspring construction including adjacent strings of pocketed coil springs secured to each other along tangential surfaces by lines of adhesive applied thereto.

It is another object of the invention to provide a relatively high speed method of manufacturing innerspring constructions by applying a hot melt adhesive to selected portions of strings of pocketed coil springs and securing them together.

The product manufactured in accordance with the invention includes a square array of pocketed coil springs defined by horizontal and vertical rows. The rows in one direction are defined by interconnected strings of coils. Each string is connected to an adjacent string by a line of adhesive along the tangential lines(s) of intersection between each pocketed coil thereof and the coil(s) in each adjoining row. The adhesive is preferably applied as a series of dots or strips defining a connecting line between each pair of adhered pockets. The length of this line can be varied to provide selected firmness of the innerspring assembly. Longer lines have been found to increase firmness.

Depending upon whether mass production is desired, the method of manufacturing the innerspring according to the invention can be varied. For a small operation, a single head adhesive applicator can be employed. The operator applies adhesive to one coil at a time and lays it on to an adjoining row. Each row is secured in this fashion until an assembly of desired size has been constructed.

Mass production requires a plurality of application stations. A hot melt adhesive may be applied to each pocketed coil by providing movable applicators which traverse a portion of a string while applying adhesive thereto. The string is pressed against another string before the adhesive sets.

BRIEF DESCRIPTION OF THE DRAWINGS

FIG. 4 is a schematical front elevation view of a system for assembling strings of pocketed coil springs;

FIG. 5 is a side elevation view of the system shown in FIG. 4;

DETAILED DESCRIPTION OF THE INVENTION

Figure 1:
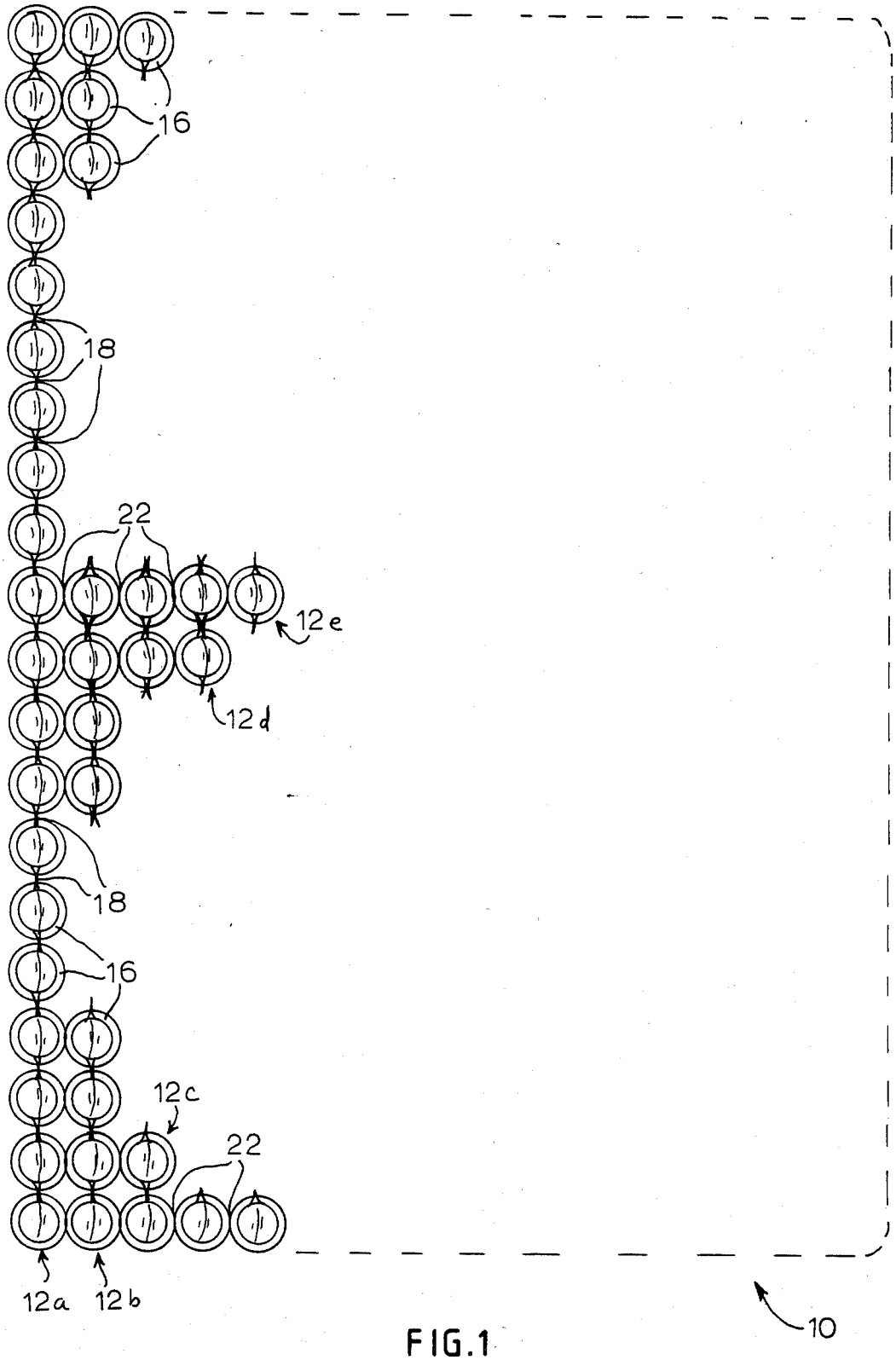
FIG. 1 is a top plan view of an innerspring construction according to the invention.

An innerspring construction 10 is provided which utilizes hot melt technology in a unique manner in the bedding and cushion field. The construction includes a plurality of parallel "strings" 12*a*, 12*b*, 12*c* etc. of coil springs 14 encased and connected by flexible fabric pockets 16. The strings may be manufactured in the manner described in U.S. Pat. No. 4,234,983 wherein the spring compartments are defined by transverse ultrasonic welds 18 across the folded plies of a weldable fabric. A suitable olefin fabric is produced by the Phillips Fibers Company and sold under the trademark DUON. The compartments or pockets are closed after spring insertion by a series of spaced longitudinal welds 20. Alternatively, the pockets may be defined by stitching or a combination of welding and stitching. The pocket material should be resistant to melting upon the application of a hot melt adhesive if such an adhesive is employed. A cotton fabric would be acceptable if ultrasonic welding is not to be used in pocket formation.

Each string is secured to the adjacent string(s) by lines 22 of adhesive provided on the external tangential surfaces of the spring pockets 16. The lines are substantially parallel to the axes of the springs 14 and positioned equidistantly between each pair of transverse welds 18.

Figure 2:
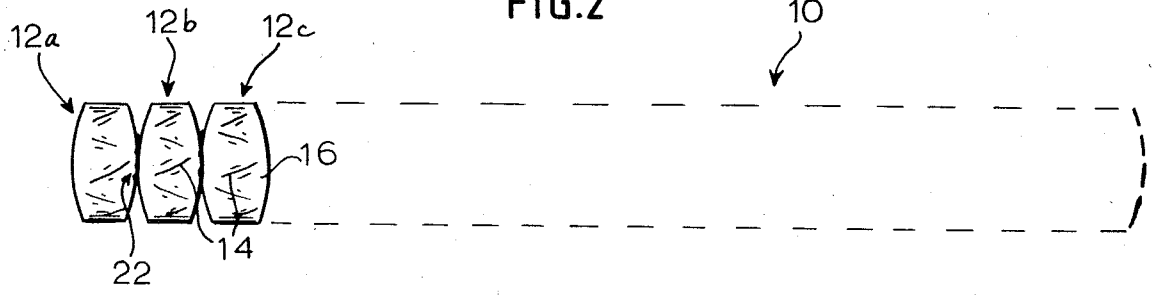
FIG. 2 is a side elevation view thereof.

Barrel-shaped coil springs as shown in FIG. 2 are preferably employed. While it would be impossible to provide a square arrangement of such coils with hog rings (which require cylindrical coils), the adhesives employed herein allow this construction to be easily fabricated. The lines 22 of adhesive are preferably applied with hot melt applicators 24. Each applicator includes a plurality of nozzles 26 fed from a common source so that the adhesive may be applied as a series of dots 28 or strips simultaneously. The dots 28 may be of the same or different sizes. Assuming constant pressure, dot size is determined by the time the nozzle spends over the coil. To adhere a pair of barrel-shaped pocketed coil springs together, it may be advantageous to apply larger dots near the ends of the lines 22 where there is not as much contact between the respective jackets. Where dots are employed, a dot diameter between one-fourth and three-eighths inches should be sufficient to insure adequate bonding without wasting adhesive material. The nozzles 26 are positioned about one-half inch from the coil jackets during adhesive application.

For smaller, more labor-intensive operations, the adhesive may be applied with a commercially available hand-held applicator having only one nozzle. The operator could apply adhesive in a continuous or discontinuous strip while using his own judgment as to regulating the amount utilized. Whether a continuous strip or a series of dots are employed, the lengths of the adhesive lines influence the firmness of the innerspring construction. Longer lines provide additional firmness. It is accordingly up to the manufacturer whether the unit should be provided with additional firmness throughout or in selected areas. In order to compensate for employing higher gauge spring wire, the manufacturer has the option of making tighter pockets with longer adhesive lines securing the strings of pocketed coils and thereby maximizing firmness.

The choice of a suitable adhesive is determined by several factors. Since innerspring units are often incorporated within mattresses, the adhesive must be substantially odorless when dry. It must also be compatible with the fabric which encases the coil springs. The "open" time of the adhesive should be sufficiently long to allow adjacent pocketed coils or strings thereof to be joined, but not excessively long so as to impede the manufacturing operation. Hot melt adhesives such as EASTOBOND ® A-337, a product of Eastman Chemical Products, Inc. of Kingsport, Tenn., Jet-Melt ® Adhesive 3764, a product of the 3M Company, and Bostik 4252, a polyamide hot melt adhesive available from Bostik Division, Middleton, Mass., may be utilized.

Figure 3:
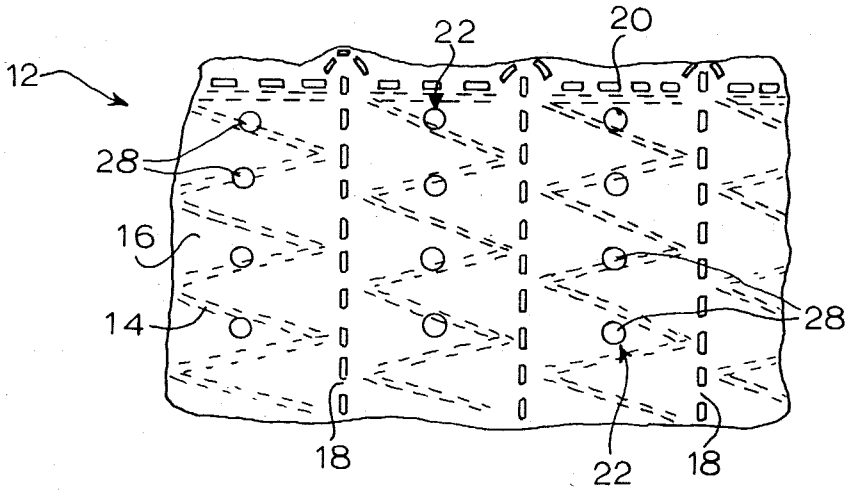
FIG. 3 is a side elevation view of a portion of a string of pocketed coil springs having an adhesive applied along the outer surfaces thereof.

The methods by which the innerspring construction according to the invention may be produced vary depending upon the scale of the operation. As discussed above, a small manufacturer may choose to employ hand-held single-head applicators and apply adhesive to one coil at a time in securing one string to another. The applicator may include one or more nozzles. A four-nozzle apparatus is utilized to produce the dot pattern shown in FIG. 3. The end dots are spaced about one inch from the ends of the coil spring.

A more highly automated system is shown in FIGS. 4–5. A plurality of applicators 24, each having four nozzles 26, are mounted for reciprocal motion to an upper support 29. Rods 30 push or pull the applicators as they traverse a string of pocketed coil springs. Each deposits four dots on a coil jacket as it proceeds along the string. It is not necessary to stop the applicator over each pocketed spring, a fact which enhances manufacturing efficiency. Mechanical sensors (not shown) may be provided for detecting when an applicator is over the appropriate portion of each pocket so that adhesive is dispensed at the correct time. Alternatively, the applicator may be microprocessor controlled for dispensing adhesive properly. As soon as the pockets are all treated with adhesive, the partially completed innerspring constructon is moved down with respect to the applicators and another string positioned thereon. The process is repeated until a construction of desired size has been created. Additional applicators may be employed if greater speed is required.

Where two applicators are employed, each traverses one-half of the string and somewhat beyond the end thereof. When they complete the operation, they move beyond the ends of the string to allow the next string to be positioned. They then traverse this next string in the same manner as the prior one.

Control means may be provided to automatically move the partially completed innerspring construction down the equivalent of one spring diameter as soon as the adhesive application step is finished. To insure a good seal, each new string may be urged towards the previously treated string by a series of spacer bars 32 positioned between each coil spring. Such bars also insure that each string 12 is properly aligned with respect to the others and that the nozzles 26 will be correctly positioned. Pressure is exerted just prior to the adhesive application step. The bars are withdrawn subsequent to such application to allow a new string to be inserted, but not until the partially completed construction is lowered.

The partially completed innerspring construction may be supported by any suitable means which insure that the string to receive adhesive is in proper position with respect to the applicators. As shown in FIG. 5, a vertically movable support 34 is provided. A first string **12*a* is positioned on this support assembly and adhesive is applied thereto. The support then moves down a distance equal to one coil diameter. The spacer bars 32 are also arranged to move down a limited distance to insure the string travels with the support. The bars are then withdrawn and move up to apply pressure to the next string. A second string 12*b*** is then positioned over the first and the spacer bars move out and down to apply pressure thereto. Adhesive is applied, the spacer bars and support move down, and another string is readied for insertion.

The innerspring assembly apparatus may be designed to allow the operator to lay a string **12*d* of coil springs on a conveniently located shelf 36 as shown in FIG. 5. A push bar 38 is used to move it from the shelf and on to the previous string 12*c* while the adhesive is still hot. A wall surface 40 opposing the edge of the shelf 36 insures the string 12*d* does not overshoot the partially completed construction. The string having the hot adhesive is preferably located slightly below the level of the shelf 36 so that the new string does not slide across it while being pushed by bar 38. String 12*d* will instead tend to drop onto string 12*c*. The spacer bars then immediately move out and down to apply pressure. Microprocessor controls may be employed to properly sequence all functions. Support 34** needs to be able to travel only about four feet to allow the production of most innerspring sizes. King size innerspring constructions can be manufactured by producing two smaller units and combining them with a hand-held applicator. The support can be designed to travel more than four feet if desired.

It has been found that commercially available hot melt adhesives exist today which allow sufficient time for the above steps to be completed without danger of premature setting. In tests run with the Bostik 4252 hot melt adhesive, strings were successfully adhered as much as thirty seconds after adhesive application. While it is desirable to bring the strings into contact with each other before this to insure a good seal, the task can be reliably accomplished with either manual or semi-automatic systems.

Metering of the correct amount of adhesive is most accurate when the applicator is under electronic control. Since the amount deposited is a function of time, the applicator can be actuated for precise periods for each pocketed coil. The distance between the nozzles and strings is also more accurately maintained with an automatic system as shown in FIGS. 4–5.

Due to the barrel-shaped configuration of the pocketed springs, the strings may not overlie each other as precisely as flat adjoining surfaces would. Adhesive patterns as shown in FIGS. 6 and 7 help insure that adjacent strings are reliably bonded upon cooling and setting.

Figure 6:
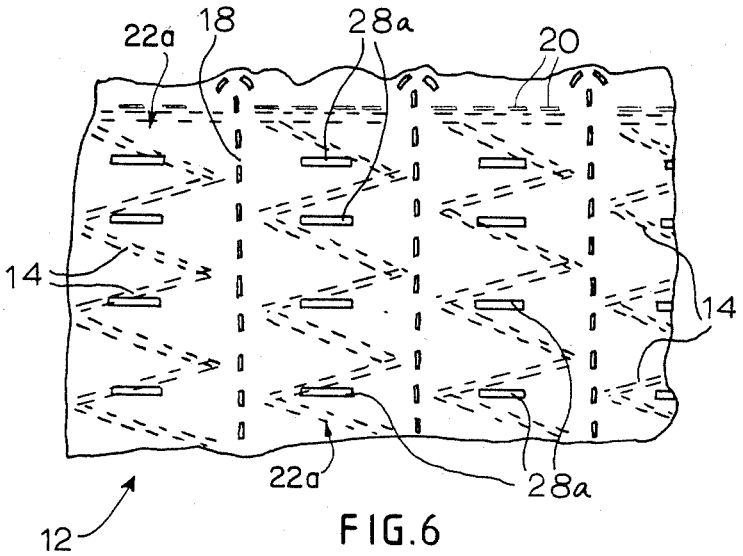
FIG. 6 is a front elevation view of a portion of a string of pocketed coil springs, each spring pocket including a series of adhesive lines thereon.

FIG. 6 illustrates a portion of a string of pocketed coil springs having a series of elongate lines 28*a* rather than dots. The lines are formed by actuating the applicator for a sufficient length of time as it passes over each pocket. Each line is about one-sixteenth inch wide by three- quarters of an inch long and extends across the line 22*a* in which adjacent coil spring of two strings would be tangent. Even if adjacent springs are slightly twisted, this adhesive pattern will insure an adequate bond.

Figure 7:
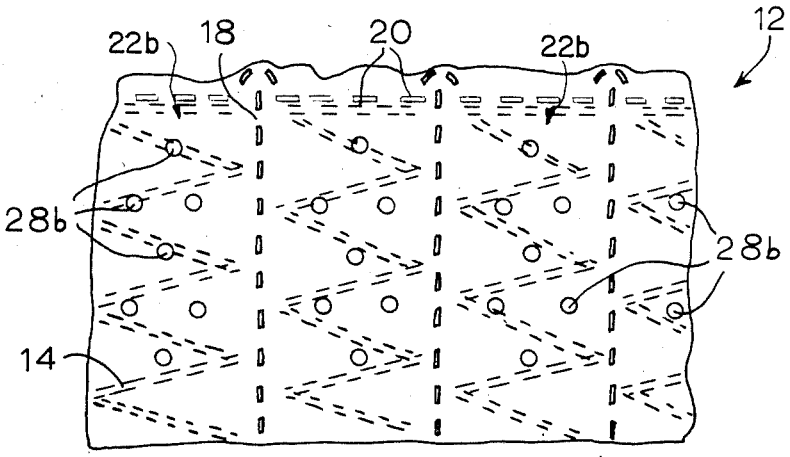
FIG. 7 is a front elevation view of a portion of a string of pocketed coil springs, each spring pocket including a pattern of adhesive deposits thereon.

FIG. 7 illustrates a pattern including dots 28*b* both on the tangeant line of each spring jacket and on either side as well. It functions in the same manner as the pattern shown in FIG. 6. Since seven dots are used rather than the four shown in FIG. 3, they may be somewhat smaller in size. In effect, the dots define a wide line 22*b* of connection between adjacent pockets.

A nested array of coil springs may also be manufactured in accordance with the invention, but is not as economical as the preferred square array. The adhesive would be applied in a different location if this approach was adopted.

It would also be possible to manufacture the innerspring construction from a single length or string of pocketed coil springs as presently done when using the apparatus described in U.S. Pat. No. 4,393,792. The string would be folded back and forth across itself with adhesive being applied to the jackets prior to making each fold.

What is claimed is:

1. A self-supporting innerspring construction comprising:

a plurality of strings of pocketed springs, each of said strings including a plurality of interconnected fabric compartments, each of said compartments containing a spring;

said compartments each including a top surface, a bottom surface, and an arcuate side wall connecting said top and bottom surfaces;

each spring having a longitudinal axis extending between the top and bottom surfaces of the compartment within which it is contained;

each of said side walls of said compartments bearing respectively against the side wall of a compartment of an adjacent string such that the longitudinal axes of the springs within said compartments are substantially parallel;

each of said compartments including a discrete, adhesive line on the side wall thereof and running in the direction between said top and bottom surfaces, said adhesive lines connecting the compartments of adjacent strings along lines defined by the bearing of said arcuate side walls of adjacent compartments against each other.

2. An innerspring construction as defined in claim 1 wherein each of said adhesive lines are comprised of a hot melt material.

3. An innerspring construction as defined in claim 1 wherein said adhesive lines are defined by a plurality of discrete adhesive deposits.

4. An innerspring construction as defined in claim 3 wherein said discrete adhesive deposits are in the form of elongate parallel lines.

5. An innerspring construction as defined in claim 3 wherein said discrete adhesive deposits are in the form of dots of selected size.

6. An innerspring construction as defined in claim 5 wherein said dots are between one-fourth and three-eighths inches in diameter.

7. An innerspring construction as defined in claim 1 wherein said strings are separate from each other and of equal length.

8. An innerspring construction as defined in claim 1 wherein said springs are barrel-shaped coil springs.

9. An innerspring construction as defined in claim 1 wherein said fabric compartments of each string are defined by a folded, elongate strip of resilient, fabric material and a plurality of transverse, linear connections between plies of said resilient, fabric material, said adhesive lines running substantially mid-way between each of said transverse, linear connections and parallel thereto.

10. An innerspring construction as defined in claim 9 including a single adhesive line running between said transverse, linear connections and parallel thereto.

11. An innerspring construction as defined in claim 9 wherein each of said adhesive lines are comprised of hot melt material.

12. A self-supporting innerspring construction comprising:

a plurality of strings of pocketed springs, each of said strings including a plurality of interconnected fabric compartments, each of said compartments containing a spring;

said compartments each including a top surface, a bottom surface, and an arcuate side wall connecting said top and bottom surfaces;

each spring having a longitudinal axis extending between the top and bottom surfaces of the compartment within which it is contained;

each of said side walls of said compartments bearing respectively against the side wall of a compartment of an adjacent string such that the longitudinal axes of the springs within said compartments are substantially parallel;

each of said compartments including a plurality of discrete hot melt deposits on the side wall thereof, at least one of said deposits on each compartment connecting it to the compartment of an adjacent string which bears against it.

13. An innerspring construction as defined in claim 12 wherein said hot melt deposits are dots of hot melt material which form a single line on each compartment running in the directions between said top and bottom surfaces.

14. An innerspring construction as defined in claim 12 wherein said hot melt deposits include parallel, elongate lines of hot melt material which form a single line running in the direction between said top and bottom surfaces.

15. An innerspring construction as defined in claim 12 wherein said fabric compartments of each string are defined by a folded, elongate strip of resilient, fabric material and a plurality of transverse, linear connections between plies of said material, said hot melt deposits being positioned between said transverse, linear connections.

16. An innerspring construction as defined in claim 15 wherein each of said compartments bears against the compartment of an adjacent string substantially midway between said transverse, linear connections of said resililent, fabric material.

* * * * *